US011311112B2

(12) United States Patent
Cailley et al.

(10) Patent No.: US 11,311,112 B2
(45) Date of Patent: Apr. 26, 2022

(54) SUPPLE MEMBER WITH ADJUSTABLE STIFFNESS FOR LYING AND/OR SITTING FURNITURE

(71) Applicant: TOURNADRE SA STANDARD GUM, Bourges (FR)

(72) Inventors: Géraud Cailley, Bourges (FR); Pascal Lobry, Bourges (FR); Jacques Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 104 days.

(21) Appl. No.: 16/720,800

(22) Filed: Dec. 19, 2019

(65) Prior Publication Data

US 2020/0205577 A1 Jul. 2, 2020

(30) Foreign Application Priority Data

Dec. 21, 2018 (FR) ..... 1874040

(51) Int. Cl.

| | |
|---|---|
| ***A47C 27/06*** | (2006.01) |
| ***A47C 23/043*** | (2006.01) |
| ***A47C 7/34*** | (2006.01) |
| ***A47C 23/05*** | (2006.01) |

(52) U.S. Cl.

CPC ..... *A47C 23/0435* (2013.01); *A47C 7/342* (2013.01); *A47C 7/345* (2013.01); *A47C 23/05* (2013.01)

(58) Field of Classification Search

CPC ..... A47C 27/06; A47C 27/065; A47C 27/04; A47C 23/04; A47C 23/0438

See application file for complete search history.

(56) References Cited

U.S. PATENT DOCUMENTS

| | | | | |
|---|---|---|---|---|
| 1,020,350 | A * | 3/1912 | Hawkes | A47C 23/0438 5/256 |
| 2,842,784 | A * | 7/1958 | Grund | A47C 27/061 5/697 |
| 4,667,357 | A | 5/1987 | Fortune | |
| 6,477,727 | B1 * | 11/2002 | Fromme | A47C 23/002 267/81 |
| 6,487,738 | B1 * | 12/2002 | Graebe | A47C 23/043 267/82 |
| 6,826,791 | B2 | 12/2004 | Fromme | |

(Continued)

FOREIGN PATENT DOCUMENTS

| | | | |
|---|---|---|---|
| DE | 102008050108 | A1 | 4/2010 |
| EP | 1155643 | A2 | 11/2001 |

(Continued)

*Primary Examiner* — Peter M. Cuomo
*Assistant Examiner* — Ifeolu A Adeboyejo
(74) *Attorney, Agent, or Firm* — The Webb Law Firm

(57) ABSTRACT

The invention relates to a supple member with adjustable stiffness for lying and/or sitting furniture. This member includes one or more adjustable helical springs and a rotary part. The rotary part includes a hub able to rotate about the central axis and one or more elastically flexible fingers. Each finger extends from a first end secured to the hub of the rotary part, over an arc of circle about the central axis, to a second end, and cooperates with a corresponding end of one or more of the adjustable helical springs.

12 Claims, 7 Drawing Sheets

(56) References Cited

U.S. PATENT DOCUMENTS

| | | | | |
|---|---|---|---|---|
| 2009/0014929 | A1* | 1/2009 | Bock | A47C 23/002 267/103 |
| 2018/0325273 | A1* | 11/2018 | Cailley | A47C 27/065 |
| 2018/0325275 | A1* | 11/2018 | Cailley | A47C 27/061 |

FOREIGN PATENT DOCUMENTS

| | | | |
|---|---|---|---|
| EP | 1386564 | A1 | 2/2004 |
| EP | 3400841 | A1 | 11/2018 |
| EP | 3400842 | A1 | 11/2018 |
| WO | 9627312 | A1 | 9/1996 |
| WO | 2008015235 | A1 | 2/2008 |

* cited by examiner

[Fig. 1A]
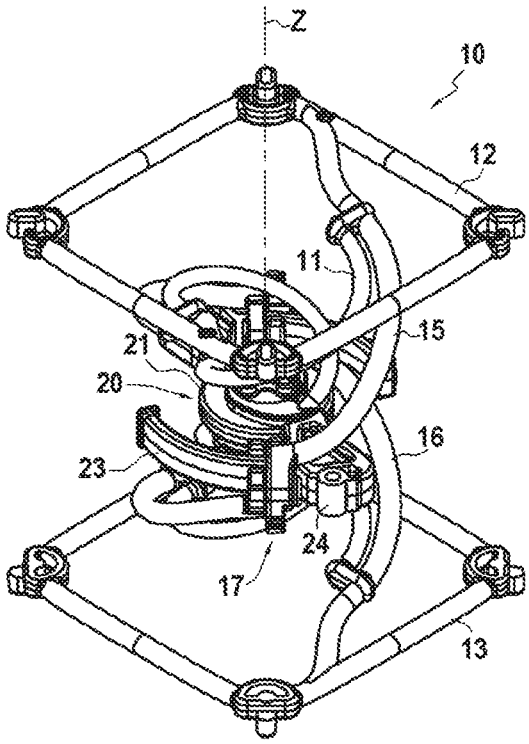
[Fig. 1B]
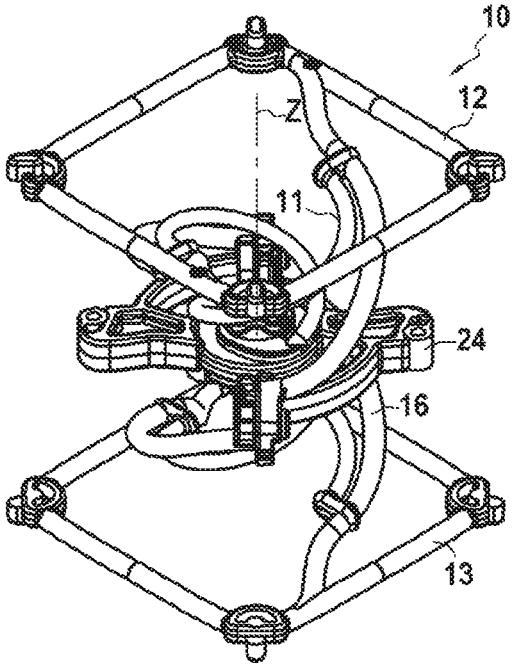

[Fig. 2A]
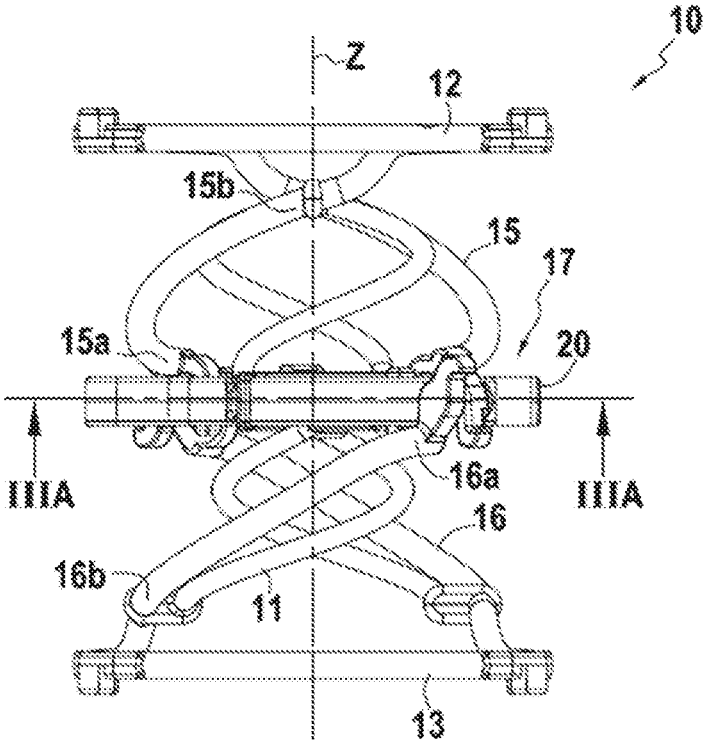
[Fig. 2B]
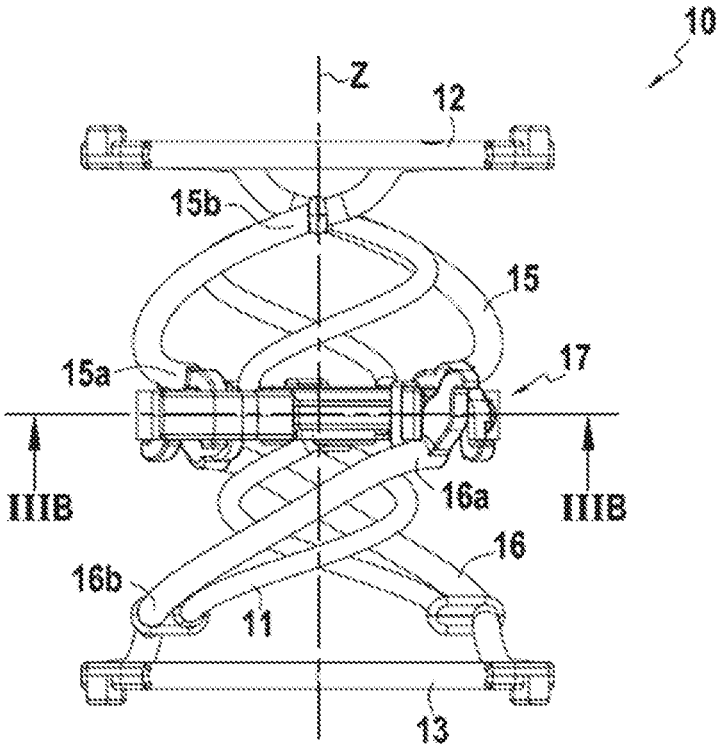

[Fig. 3A]
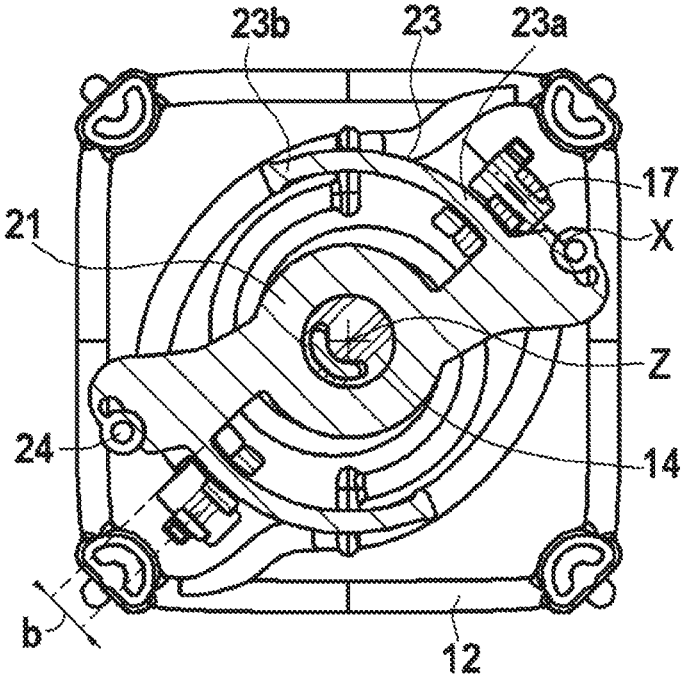
[Fig. 3B]
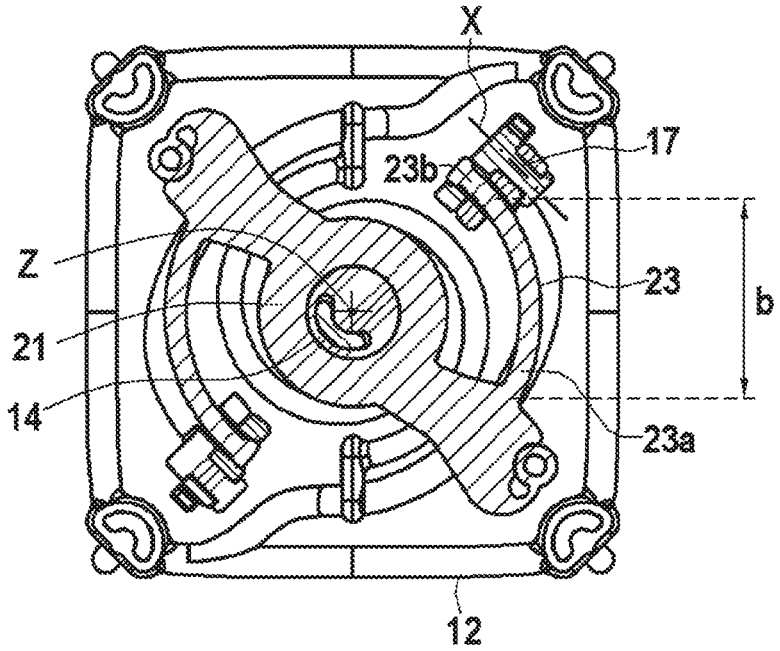

[Fig. 4]
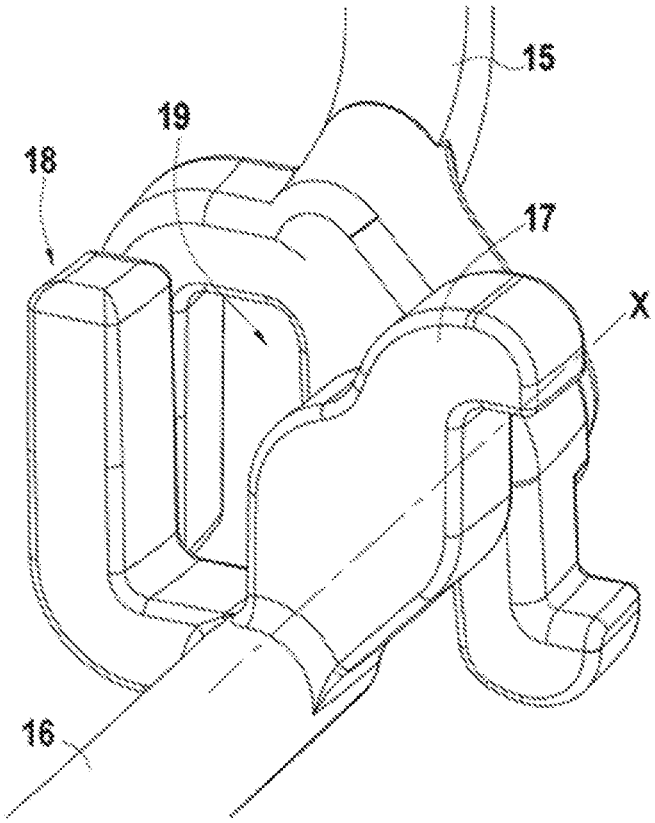

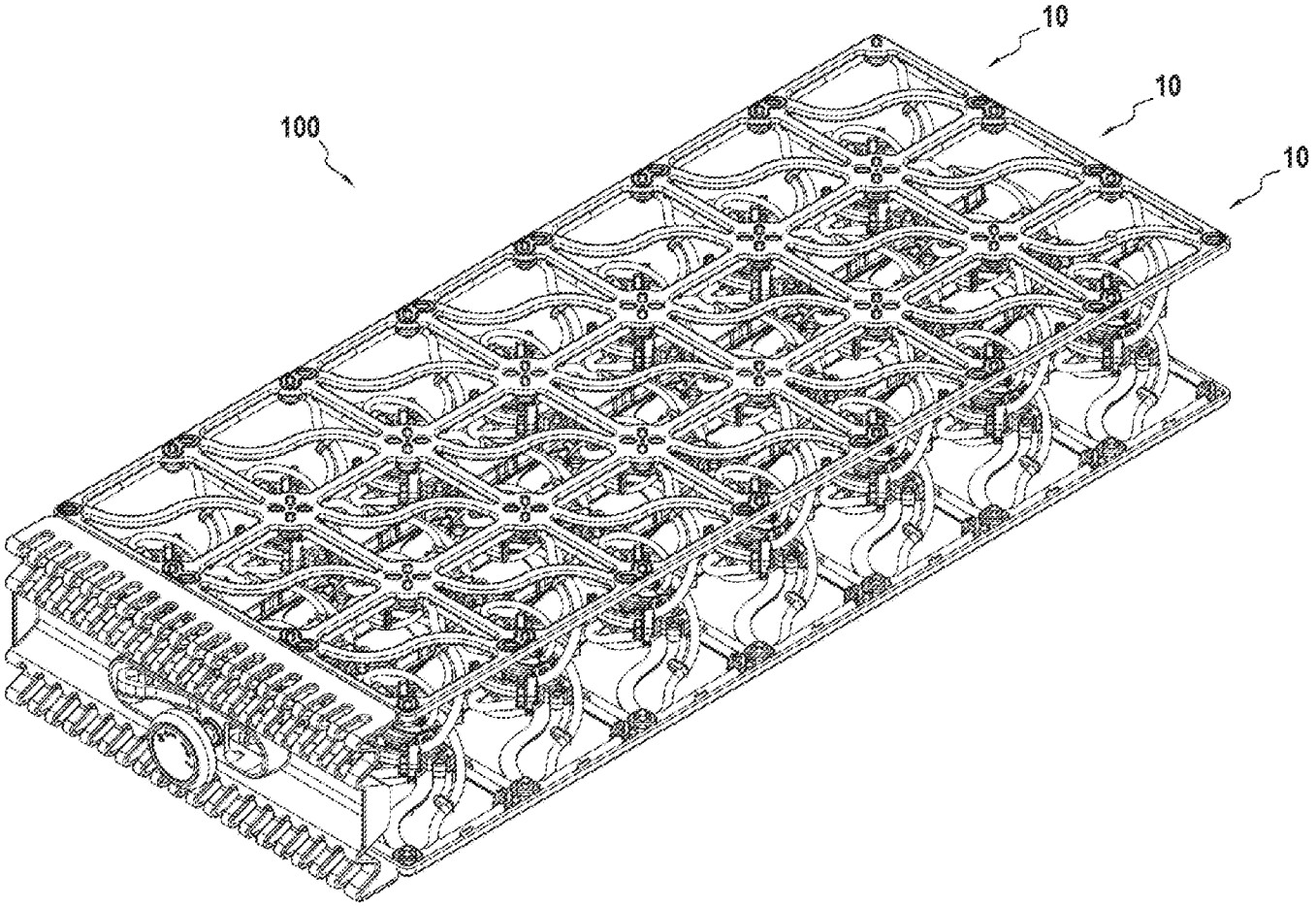
[Fig. 5]

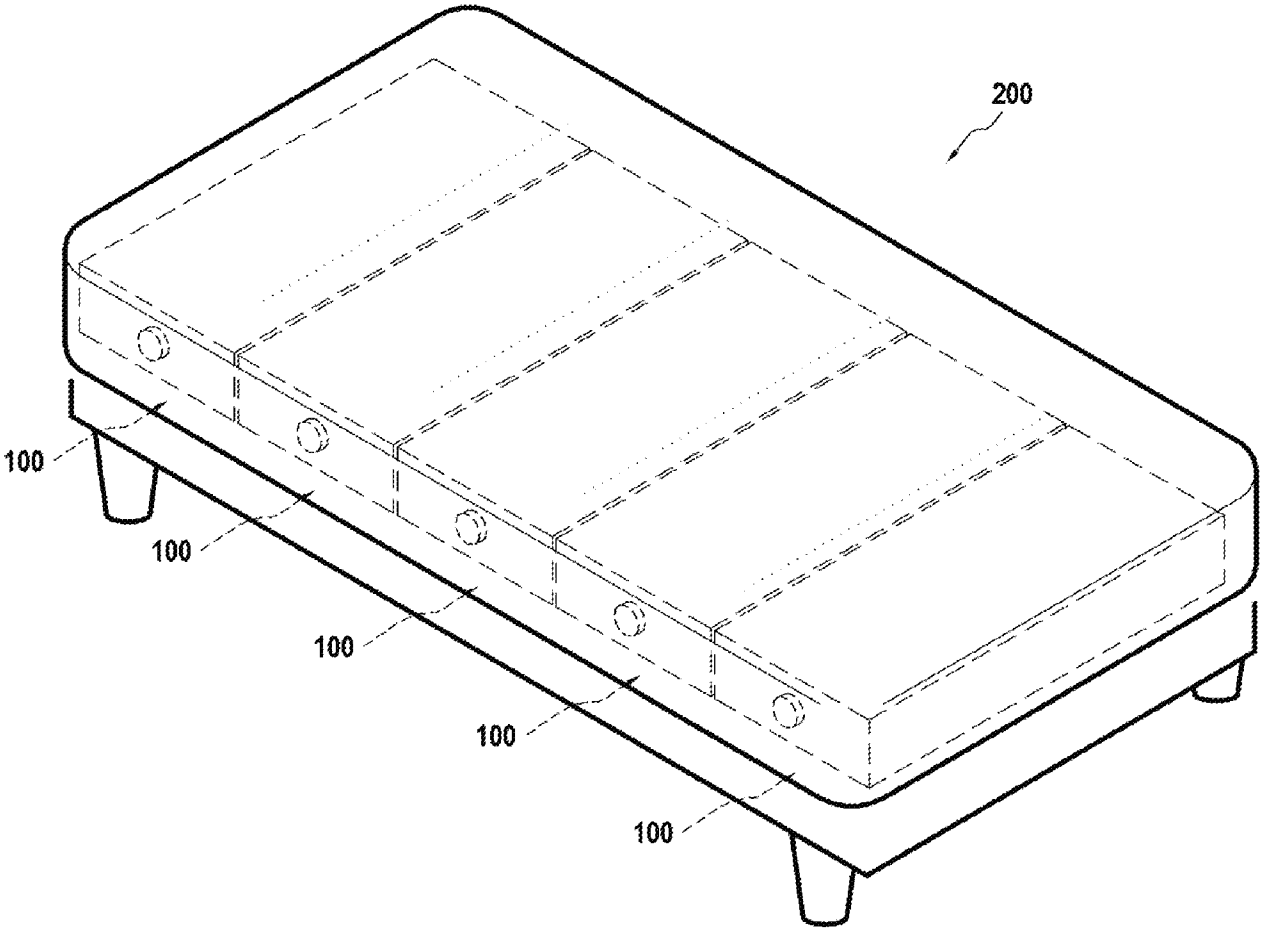
[Fig. 6]

[Fig. 7]
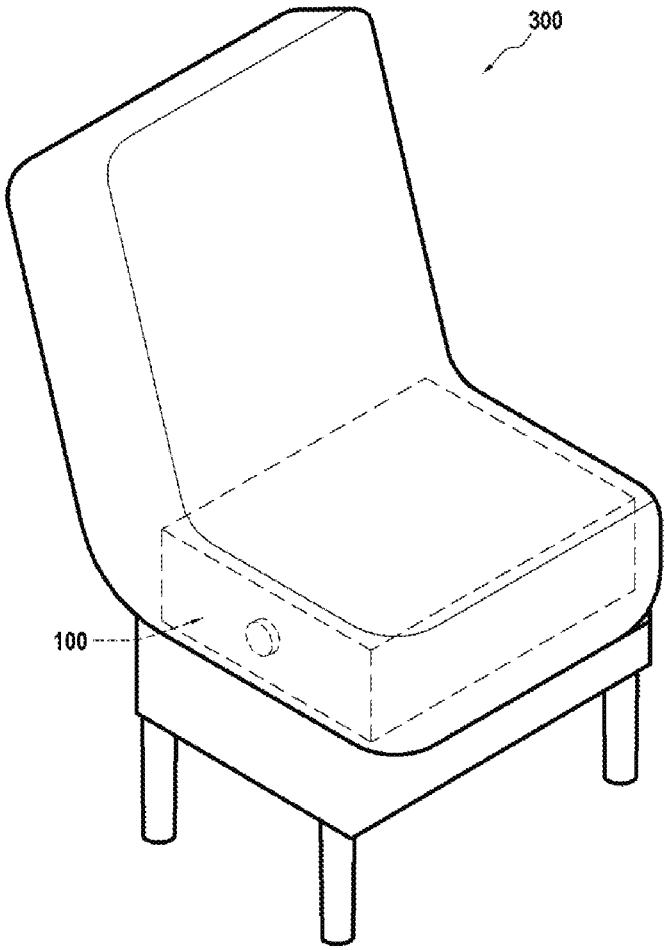

SUPPLE MEMBER WITH ADJUSTABLE STIFFNESS FOR LYING AND/OR SITTING FURNITURE

CROSS-REFERENCE TO RELATED APPLICATION

This application claims priority to French Patent Application No. 1874040 filed Dec. 21, 2018, the disclosure of which is hereby incorporated by reference in its entirety.

TECHNICAL FIELD

The present disclosure relates to the furnishing field and more particularly to a supple member with adjustable stiffness for lying and/or sitting furniture. It is meant by "lying and/or sitting furniture" not only furniture intended for domestic use or in collective facilities but also, for example, seats, beds, berths and/or stretchers intended for transportation means.

PRIOR ART

In order to make a sitting, backrest or lying surface adaptable to the preferences and anatomy of different users, assemblies, such as mattresses or bed bases, having supple members with adjustable stiffness have been previously disclosed, for example, in documents EP 1 386 564 A1, EP 1 155 643 A2, WO 2008/015235, WO 96/27312, U.S. Pat. No. 4,667,357 or DE 2008 050 108 A1. Typically, the stiffness of the members is adjusted with restrictions to their mechanical deformation. For this, however, the proposed mechanisms have a significant complexity and/or space requirement.

SUMMARY OF THE INVENTION

The present disclosure aims at overcoming the aforementioned drawbacks, by proposing a supple member with adjustable stiffness for lying and/or sitting furniture, with a simple structure and limited space requirement.

To achieve this purpose, according to a first aspect of this disclosure, the supple member may comprise one or more adjustable springs, each configured to be deformed radially relative to a central axis under the effect of an axial stress along the central axis, and a rotary part including a hub able to rotate about the central axis and one or more elastically flexible fingers, each extending from a first end secured to the hub of the rotary part, over an arc of circle about the central axis, to a second end, which can in particular be a free end, and each cooperating, in the radial direction relative to the central axis, with one or more of the adjustable springs. Each adjustable spring can in particular be a helical spring, although other shapes can also be envisaged.

Thus, the rotation of the rotary part about the central axis allows varying a cantilever, in a plane perpendicular to the central axis, from a bearing point of each adjustable spring on the elastically flexible finger, relative to the first end of the elastically flexible finger. Thanks to the variation of this cantilever, it is possible to adjust, even gradually, the strength that will be provided, by the finger, against the radial stress exerted by the adjustable spring relative to the central axis and therefore against the compression of the adjustable spring along the central axis.

The adjustable springs may comprise one or more pairs of adjustable springs, each pair of adjustable springs comprising an upper adjustable spring and a lower adjustable spring whose ends are connected by a corresponding hinge with a pivot axis orthogonal to the central axis. Particularly, each finger can pass through a space defined by a pair of jaws associated with the corresponding hinge. The upper and lower adjustable springs can thus be arranged in series and adjustable together. However, other arrangements can also be envisaged, such as for example each finger forms the pivot of the corresponding hinge connecting an upper adjustable spring and a lower adjustable spring.

The supple member may further include one or more inner springs coaxial with the adjustable springs. The inner springs may be helical, comprising at least two springs disposed in series and/or at least two springs disposed in parallel. However, other arrangements and/or alternative shapes can also be envisaged.

A second aspect of the present disclosure relates to an assembly comprising a plurality of supple members with adjustable stiffness such as the aforementioned supple member, oriented in parallel. Such an assembly can therefore provide a bearing surface whose firmness will be adjustable by the stiffness of the supple members. It can be envisaged that the rotary parts of the supple members of this assembly are coupled in rotation, so as to allow the simultaneous adjustment of the stiffness of several supple members of the assembly.

A third aspect of the present disclosure relates to a lying or sitting furniture comprising one or more assemblies such as the abovementioned assembly. These assemblies can be integrated, for example, in a mattress, bed base and/or cushion forming part of the furniture.

A fourth aspect of the present disclosure relates to a method for using a supple member with adjustable stiffness such as the abovementioned member, comprising at least one step of rotating the rotary part to adjust the stiffness of the supple member with adjustable stiffness.

The invention will be better understood and its advantages will become more apparent upon reading the following detailed description of one embodiment represented by way of nonlimiting example. The description refers to the appended drawings in which:

BRIEF DESCRIPTION OF THE DRAWINGS

FIG. 1A is a perspective view of a supple member according to one embodiment, with a rotary part in a first position.

FIG. 1B is a perspective view of a supple member according to one embodiment, with a rotary part in a second position.

FIG. 2A is a side view of the supple member of FIGS. 1A and 1B, with the rotary part in the first position.

FIG. 2B is a side view of the supple member of FIGS. 1A and 1B, with the rotary part in the second position.

FIG. 3A is a sectional view, in a plane perpendicular to a central axis, of the supple member of FIGS. 1A and 1B, with the rotary part in the first position.

FIG. 3B is a sectional view, in a plane perpendicular to a central axis, of the supple member of FIGS. 1A and 1B, with the rotary part in the second position FIG. 4 is a detailed view of a hinge of the supple member of the preceding figures.

FIG. 5 is a perspective view of an assembly of several supple members similar to that of the preceding figures.

FIG. 6 is a schematic view of a bed incorporating assemblies similar to that of FIG. 5.

FIG. 7 is a schematic view of a sofa incorporating an assembly similar to that of FIG. 5.

DESCRIPTION OF THE EMBODIMENTS

A supple member 10 for sitting or lying furniture such as, for example, beds, settees, bed-settees, sofas, etc., and whose compression stiffness along a central axis Z is adjustable, is illustrated in FIGS. 1A to 3B. This supple member 10 may comprise several springs oriented along this central axis Z. Thus, the supple member 10 may comprise one or more inner springs 11. As illustrated, these inner springs 11 may in particular be helical springs arranged in pairs, each pair of inner springs 11 comprising two springs arranged in parallel, and the pairs being arranged in series between an upper support 12 and a lower support 13 at the ends of the supple member 10 along the central axis Z, and connected by a central body 14. However, the inner springs could possibly be different in number, be differently arranged or even take an entirely different shape, such as for example foam springs.

The supple member 10 may further comprise one or more adjustable springs. These adjustable springs can in particular be helical springs, disposed coaxial with the inner springs 11 radially outside them relative to the central axis X, although other configurations can also be envisaged. Although, in the example illustrated in FIGS. 1A to 3B, the supple member 10 includes two pairs of adjustable helical springs, a different number of adjustable helical springs, equal to or greater than one, can also be envisaged. As illustrated, the adjustable springs can in particular be arranged in pairs, and each pair may comprise an upper adjustable spring 15 and a lower adjustable spring 16, connected together, at ends 15*a*, 16*a*, by a corresponding hinge 17 with a pivot axis X orthogonal to the central axis Z and radially offset relative thereto. Opposite ends 15*b* and 16*b* of the upper 15 and lower 16 adjustable springs may be secured to an upper support 12 and to a lower support 13 of the supple member 10, respectively.

In addition, the supple member 10 may comprise a rotary part 20 able to rotate about the central axis Z. As illustrated in FIGS. 1A to 3B, this rotary part 20 may comprise a hub 21 engaged around the central body 14 so as to be able to rotate about the central axis Z relative to this central body 14, while restricting their relative movement in the direction of the central axis Z. In addition, the rotary part 20 may comprise one or more radial arms 22 extending from the hub 21 and secured thereto, and one or more elastically flexible fingers 23, each extending, over an arc of circle about the central axis Z, from a first end 23*a* secured to the hub 21 at an outer periphery of the hub 21 of the rotary part 20 through one of the radial arms 22, to a second end 23*b*, which can be, as illustrated, a free end. Moreover, the rotary part 20 may comprise connections 24 for its actuation in rotation.

As illustrated in detail in FIG. 4, each hinge 17 may comprise one or more pairs of jaws 18, each pair of jaws 18 defining a space 19 receiving one of the rails 23. As illustrated, this space 19 defined by the jaws 18 can be closed all around the finger 23.

In operation, the rotation of the rotary part 20 about the central axis Z allows increasing and/or decreasing the cantilever b of each corresponding hinge 17, in a plane perpendicular to the central axis Z, relative to the first end 23*a* of the corresponding finger 23, so as to gradually adjust the radial-displacement strength of the hinge 17 relative to the central axis Z, and therefore the compressive strength of the supple member 10, strength that the finger 23 will flexurally provide. Thus, when the cantilever b is smaller, as in the angular position of the rotary part 20 illustrated in FIGS. 1A, 2A and 3A, the strength provided, by the fingers 23, against the radial displacement of the corresponding hinges 17, and therefore against the compression of the supple member 10 along the central axis, will be higher than when the cantilever b is further marked, as illustrated in FIGS. 1B, 2B and 3B.

Each of the components of the supple member 10 can be made of organic polymeric material, and produced in particular by injection molding. As illustrated in FIGS. 5 to 7, a plurality of similar supple members 10 can be combined into a single assembly 100 within a lying and/or sitting furniture, such as, for example the bed 200 in FIG. 6 or the sofa 300 in FIG. 7. In this assembly 100, the central axes Z of the supple members 10 can be oriented in parallel, and the rotary parts 20 can be coupled in rotation, so as to allow the simultaneous adjustment of the stiffness of several supple members 10 of the assembly 100. The assembly 100 can be integrated into a mattress, bed base or cushion. It can also be envisaged to integrate several assemblies 100, with adjustable stiffness separately, into a single mattress, bed base or cushion, so as to allow the user to adjust the stiffness in separate areas for better comfort.

Although the present invention has been described with reference to specific examples, it is obvious that various modifications and changes can be made to these examples without departing from the general scope of the invention as defined by the claims. Therefore, the description and the drawings should be considered in an illustrative rather than restrictive sense.

The invention claimed is:

1. A supple member with adjustable stiffness for lying and/or sitting furniture, comprising:

one or more adjustable springs, each configured to be deformed radially relative to a central axis under the effect of an axial stress along the central axis, and a rotary part including a hub able to rotate about the central axis and one or more elastically flexible fingers in a plane perpendicular to the central axis, each extending from a first end secured to the hub at an outer periphery of the rotary part, over an arc of circle about the central axis, to a second end, and each cooperating, in the radial direction relative to the central axis, with one or more of the adjustable springs.

2. The supple member with variable stiffness according to claim 1, wherein the second end of each finger is a free end.

3. The supple member with adjustable stiffness according to claim 1, wherein each adjustable spring is a helical spring disposed about the central axis.

4. The supple member with adjustable stiffness according to claim 1, wherein the adjustable springs comprise one or more pairs of adjustable springs, each pair of adjustable springs comprising an upper adjustable spring and a lower adjustable spring whose ends are connected by a corresponding hinge with a pivot axis orthogonal to the central axis.

5. The supple member with adjustable stiffness according to claim 4, wherein each finger passes through a space delimited by a pair of jaws associated with the corresponding hinge.

6. The supple member with adjustable stiffness according to claim 1, further including one or more coaxial inner springs of the adjustable springs.

7. The supple member with adjustable stiffness according to claim 6, wherein the inner springs comprise at least two springs disposed in series.

8. The supple member with adjustable stiffness according to claim 6, wherein the inner springs comprise at least two springs disposed in parallel.

9. The supple member with adjustable stiffness according to claim 6, wherein the inner springs are helical.

10. An assembly comprising a plurality of supple members with adjustable stiffness according to claim 1, oriented in parallel.

11. A lying or sitting furniture comprising one or more assemblies according to claim 10.

12. A method for using a supple member with adjustable stiffness according to claim 1, comprising at least one step of rotating the rotary part to adjust the stiffness of the supple member with adjustable stiffness.

* * * * *